United States Patent [19]

Rich et al.

[11] 4,064,788

[45] Dec. 27, 1977

[54] CUSHIONING MEANS FOR HYDRAULIC CYLINDER

[75] Inventors: Beldon Lee Rich, Northbrook, Ill.; Zdenek J. Lansky, Solon, Ohio

[73] Assignee: Parker-Hannifin Corporation, Cleveland, Ohio

[21] Appl. No.: 709,762

[22] Filed: July 29, 1976

[51] Int. Cl.[2] ..... F15B 15/22

[52] U.S. Cl. ..... 91/395; 91/396

[58] Field of Search ..... 91/396, 395, 394, 24, 91/25, 26, 405; 92/85 B; 188/284

[56] References Cited

U.S. PATENT DOCUMENTS 3,704,650 12/1972 Berg ..... 91/396

3,964,370 6/1976 Rich ..... 91/396

*Primary Examiner*—Paul E. Maslousky

*Attorney, Agent, or Firm*—Donnelly, Maky, Renner & Otto

[57] ABSTRACT

Cushioning means for cushioning the end portion of the stroke of a piston in a cylinder comprising a stepped cushioning member or spear which enters a cylinder head bore to form therewith an annular orifice which successively decreases in area and gradually increases in radial width from one step to the next thus to decrease piston velocity at substantially uniform rate and, hence, at substantially constant deceleration with substantially constant pressure drop across the annular orifice.

3 Claims, 4 Drawing Figures

CUSHIONING MEANS FOR HYDRAULIC CYLINDER

BACKGROUND OF THE INVENTION

In the cushioning of hydraulic cylinders it is known to provide a cushioning member, such as a spear projecting axially from the head end of the piston or a sleeve projecting axially from the rod end of the piston and disposed around the piston rod, which, during the cushioned portion of the piston stroke, enters a cylinder head bore to define therewith a restricted passage of decreasing flow area through which fluid is displaced from the cylinder. A common form of cushioning member is a spear or sleeve having a frusto-conical exterior surface which forms a variable area annular orifice in which the inside diameter varies in lineal manner. Aside from the difficulty and expense of accurately grinding such frusto-conical surface on the cushioning member such variable area orifice does not produce uniform decrease in piston velocity. To achieve uniform decrease in piston velocity requires that the tapered surface be paraboloidal which would entail yet added expense in the manufacture of the cushioning member.

In other known forms of cushioning members such as those which are cylindrical with an axial groove of progressively increasing depth or those which are tubular with a series of axially spaced holes through the wall thereof which are progressively covered as the cushioning member enters the cylinder head bore, paraboloidal characteristics in the decrease of the restricted flow area cannot be achieved except by expensive and complex machining operations.

It is also known from U.S. Pat. No. 3,964,370, granted June 22, 1976 to provide a stepped cylindrical cushioning member which cooperates with a cylinder head bore to form an annular cushioning orifice which is of progressively decreasing cross-section area and increasing axial length to achieve substantially uniform decrease in piston velocity with substantially constant deceleration to smoothly cushion the piston movement without objectionable shock load.

SUMMARY OF THE INVENTION

It is a principal object of this invention to provide a stepped cushioning means having steps of saw-tooth form which substantially achieves uniform decrease in piston velocity with constant deceleration as obtainable with a cushioning spear or sleeve having a paraboloidal surface or a cylindrical stepped surface according to said copending application.

Other objects and advantages will appear from the ensuing description.

DETAILED DESCRIPTION OF A PREFERRED EMBODIMENT

Figure 1:
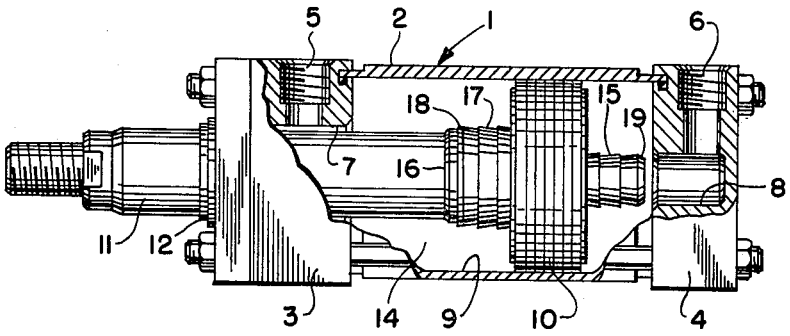
FIG. 1 is a fragmentary cross-section view of a double acting hydraulic cylinder having cushioning means according to the present invention arranged to cushion the end portions of both strokes of the piston in the cylinder.

The hydraulic cylinder herein may be a conventional double acting hydraulic cylinder 1 including a cylinder body 2 clamped between cylinder heads 3 and 4 having ports 5 and 6 opening into central bores 7 and 8. Axially slidably sealed in the cylinder bore 9 is a piston 10 which may be screw-connected to a piston rod 11 which extends through a packing gland assembly 12 in cylinder head 3 to slidably seal the piston rod 11, said piston rod 11 being of diameter less than the bore 7 in the cylinder head 3 for flow of fluid into or from the cylinder chamber 14.

In the present case, the piston rod 11 is formed with a stepped cushioning spear 15 which extends axially beyond one end of the piston 10 and which cooperates with the cylinder head bore 8 to cushion the piston stroke when the spear 15 enters the bore 8.

Figure 2:
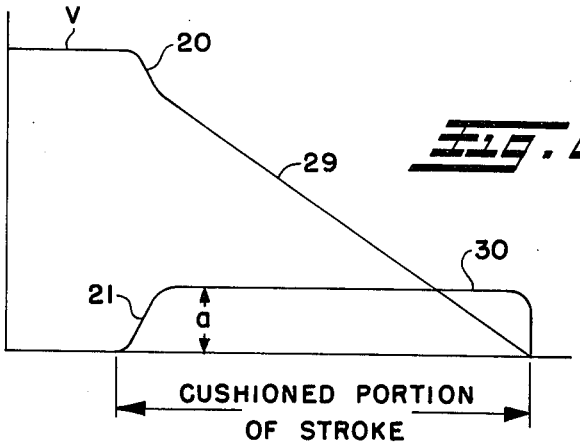
FIG. 2 is a graph showing the ideal uniform decrease in piston velocity and the constant deceleration of the piston during the cushioned portion of its stroke.
Figure 3:
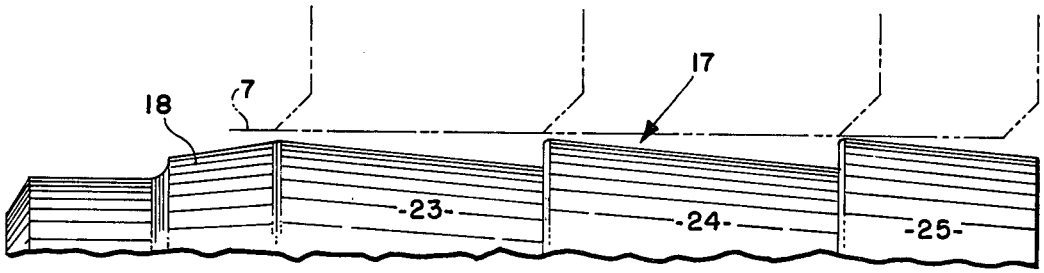
FIG. 3 is a much enlarged fragmentary elevation view of the cushioning sleeve on the piston rod.
Figure 4:
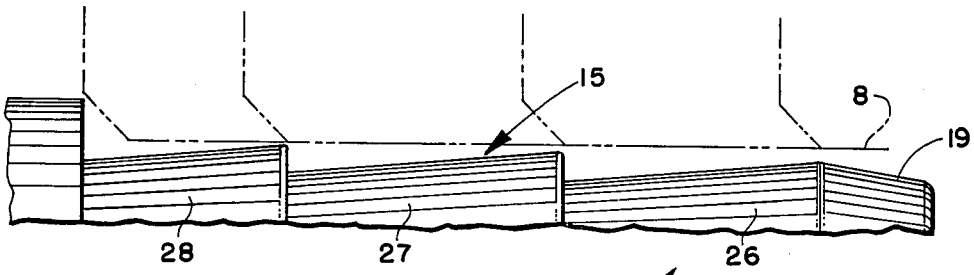
FIG. 4 is a similar much enlarged fragmentary elevation view of cushioning spear which projects axially beyond the end of the piston.

Radially floatably mounted between the other end of the piston 10 and a shoulder 16 on the piston rod 11 is a stepped sleeve 17 which cooperates with the cylinder head bore 7 to cushion the end portion of the piston stroke when the sleeve 17 enters the bore 7. In FIGS. 1, 3, and 4, as the tapered end 18 or 19 enters the respective bore 7 or 8 there will be a decrease in piston velocity V as denoted by the portion 20 of the graph in FIG. 2 and, at the same time, there will be a deceleration 21 which rises from 0 to the value *a*. As the successive steps 23, 24, and 25 of the cushioning sleeve 17 or the successive steps 26, 27, and 28 of the cushioning spear enter the respective bores 7 or 8, the piston velocity V ideally will decrease at a uniform rate as denoted by straight line 29 in FIG. 2 and by reason of such uniform rate of decrease in velocity V, the ideal deceleration line 30 will remain constant as indicated by the dimension *a* in FIG. 2.

From the formula $F = ma$ it can be seen that the force F remains constant when the deceleration *a* is a constant. As the piston velocity V decreases, the rate of flow through the cushioning orifice decreases and hence, during the cushioning operation, the size of the cushioning orifice must decrease in order to maintain the force F or pressure drop constant. As known, an inverted parabola having the general formula $x = y^2$ would provide an annular cushioning orifice having a constant pressure drop during the cushioning stroke.

In the present case, the steps 23, 24 and 25 and the steps 26, 27 and 28 are tapered at an angle of from 5 to 10 degrees with respect to the axis of the respective sleeve 17 and spear 15 thus to form sudden enlargements of the annular orifice as the steps 24 and 25 and the steps 27 and 28 enter the respective bores 7 and 8 with gradual contraction toward the preceding step or steps. The tapered stepped formation of the cushioning member 15 or 17 herein closely approximates the ideal results from a paraboloidal cushioning member or from the cylindrical stepped construction of said U.S. Pat. No. 3,964,370 but which is a great deal easier and less expensive to manufacture. As evident, only the crests of the steps need be ground, honed, or polished to precise diameters.

In connection with the cushioning means as shown in FIGS. 3 and 4, the steps 23, 24, and 25 on the cushioning sleeve 17 are smaller than the steps 26, 27, and 28 on the cushioning spear 15 because of the larger diameter of the bore 7 at the rod end and the smaller displacment of the rod end of the cylinder 1 as compared with the smaller diameter of the cylinder head bore 8 and greater displacement of the head end of the cylinder 1.

By way of illustrative example, in FIG. 3 the difference in diameter of the crests of steps 25 and 24 and the crests of steps 24 and 23 may be 0.002 inches and 0.003 inches respectively with the crest diameter of the largest step 25 being 1.9990 inches while the crest diameters of the next two steps 24 and 23 are 1.997 inches and 1.994 inches respectively. In this case, the diameter of the cylinder head bore 7 is a close fit with the crest of the largest diameter step 25 of the cushioning sleeve 17. In this example, the cylinder bore 9 is 4 inches with a rod 11 diameter of 1 3/4 inches and the length of the steps 25, 24, and 23 are respectively 0.265 inch, 0.390 inch, and 0.500 inch less the tapered end 18 of 0.140 inch length and 10° taper. The corners of the steps are rounded as shown and the tapered portion 18 is blended to the smallest step 23.

With reference to the cushioning spear as shown in FIG. 4, the difference in crest diameter of steps 28 and 27 and steps 27 and 26 are respectively 0.007 inch and 0.006 inch with the crest of the largest diameter step 28 being of 1.124 inch diameter to cooperate with bore 8, and the crests of the successive steps 27 and 26 are respectively of 1.117 inches and 1.111 inches diameter. The length of the successive steps 28, 27, and 26 may be 0.265 inch, 0.375 inch, and 0.485 inch respectively, less the tapered portion 19 of 0.140 length and 10° taper. As in connection with FIG. 3, the corners of the steps in FIG. 4 are rounded and the tapered portion 19 is blended to the smallest step 26.

It has been found that with cushioning means of the character herein disclosed the stepped and tapered cushioning sleeve 17 and cushioning spear 15 provide for a desired substantially uniform rate of pistion velocity decrease with substantially constant deceleration and hence a substantially constant pressure drop across the annular orifices which vary stepwise in cross-section area and which pregressively increase in radial width from one step to the next. It will be appreciated that in actual use of the stepped cushioning members 15 and 17 herein there will be slight pressure peaks as each step enters the respective bore 8 and 7 but these pressure peaks will only have minute effect on the desired deceleration curve. An advantage of the stepped cushioning means herein is that a cushioning problem may be solved by use of empirical data. For example, one can start with a computer designed cushioning member, take pressure and velocity traces, and modify the step diameters and positions to optimize the deceleration curve.

Although three steps 23, 24, 25 or 26, 27 and 28 have been illustrated, the number of steps can be reduced to two or increased to more than three.

The embodiments of the invention in which an exclusive property or privilege is claimed are defined as follows:

1. Cushioning means for cushioning the terminal portion of the stroke of a piston in a hydraulic cylinder wherein said cylinder has a bore in one end through which fluid is displaced from said cylinder during movement of the piston therein; said cushioning means comprising a member on said piston extending axially therefrom to enter said bore to throttle the flow of fluid through said bore during the terminal portion of said stroke; said member having first and second coaxial steps which define with said bore successive first and second annular orifices of stepwise progressively decreasing cross-section area as said piston moves in the terminal portion of said stroke; said steps being tapered to smaller diameter toward said piston to provide a sudden radial enlargement as said second step enters said bore and to provide for gradual radial contraction as said first and second steps enter said bore.

2. Cushioning means for cushioning the terminal portion of the stroke of a piston in a hydraulic cylinder wherein said cylinder has a bore in one end through which fluid is displaced from said cylinder during movement of the piston therein; said cushioning means comprising a member on said piston extending axially therefrom to enter said bore to throttle the flow of fluid through said bore during the terminal portion of said stroke; said member having a series of first, second, and third coxial steps which define with said bore successive first, second, and third annular orifices of stepwise progressively decreasing cross-section area as said piston moves in the terminal portion of said stroke; said steps being tapered to provide sudden radial enlargements as said second and third steps enter said bore and to provide for gradual radial contraction as said first, second, and third steps enter said bore; said steps being of crest diameter and of axial length and taper to effect a substantially constant pressure drop across the respective annular orifices thus to decrease the piston velocity at substantially uniform rate and constant deceleration.

3. The cushioning means of claim 2 wherein the axial spacing of the crests of said first and second steps and said second and third steps are approximately equal which is substantially greater than the axial entry of the third step into said bore at the end of the stroke of said piston, and said second orifice being of radial width several times that of said third orifice and about one half that of said first orifice.

* * * * *